US005437218A

United States Patent [19]

Papin

[11] Patent Number: 5,437,218

[45] Date of Patent: Aug. 1, 1995

[54] DIAPHRAGM PUMP HAVING VARIABLE DISPLACEMENT

[75] Inventor: Jean-Paul Papin, Creteil, France

[73] Assignee: PCM Pompes, Vanves, France

[21] Appl. No.: 222,023

[22] Filed: Apr. 4, 1994

[51] Int. Cl.[6] ..... F01B 19/00; F01B 31/14; F04B 17/00

[52] U.S. Cl. ..... 92/13.2; 92/13.8; 417/413.1

[58] Field of Search ..... 92/13.2, 13.6, 13.7, 92/13.8; 417/413.1, 214

[56] References Cited

U.S. PATENT DOCUMENTS

| | | | |
|---|---|---|---|
| 2,503,907 | 4/1950 | Hefler | 92/13.7 X |
| 2,895,424 | 7/1959 | Tramontini et al. . | |
| 3,661,167 | 5/1972 | Hussey | 92/13.2 X |
| 3,801,232 | 4/1974 | Kilayko | 92/13.8 X |
| 4,086,036 | 4/1978 | Hagen et al. | 417/413.1 |
| 4,167,896 | 9/1979 | Clements | 92/13.2 |
| 4,323,333 | 4/1982 | Apter et al. | 92/13.8 X |
| 4,856,966 | 8/1989 | Ozawa | 92/13.2 X |
| 4,993,925 | 2/1991 | Becker et al. | 417/413.1 |
| 5,074,763 | 12/1991 | Degremont . | |

*Primary Examiner*—John E. Ryznic
*Attorney, Agent, or Firm*—Larson and Taylor

[57] ABSTRACT

Diaphragm pump having a delivery rate which can be continuously adjusted between a zero value and a maximum value, comprising:

a continuously rotating eccentric drive member (6);

a connecting rod (5) with a connecting-rod big end (11–14) fitted with a bearing (10) receiving, so as to rotate freely, the member (6) and the other end of which is coupled to a central area of the diaphragm (2);

releasable coupling means in order to couple, in a selective manner, the connecting-rod big end to the member (6) during a desired fraction of stroke, which can be continuously adjusted by adjustment means (16–19).

The connecting-rod big end is fitted with at least one slide (11) extending substantially in the prolongation of the connecting rod (5) on the opposite side from the diaphragm (2) and capable of supporting the bearing (10) so as to slide freely in relation to the connecting-rod big end, and elastic return means (15) are provided in order to hold the bearing (10) at the bottom of the slide in the absence of counterforce exerted by the eccentric member on the bearing, the elastic return means acting on the bearing on the opposite side from the connecting rod.

9 Claims, 1 Drawing Sheet

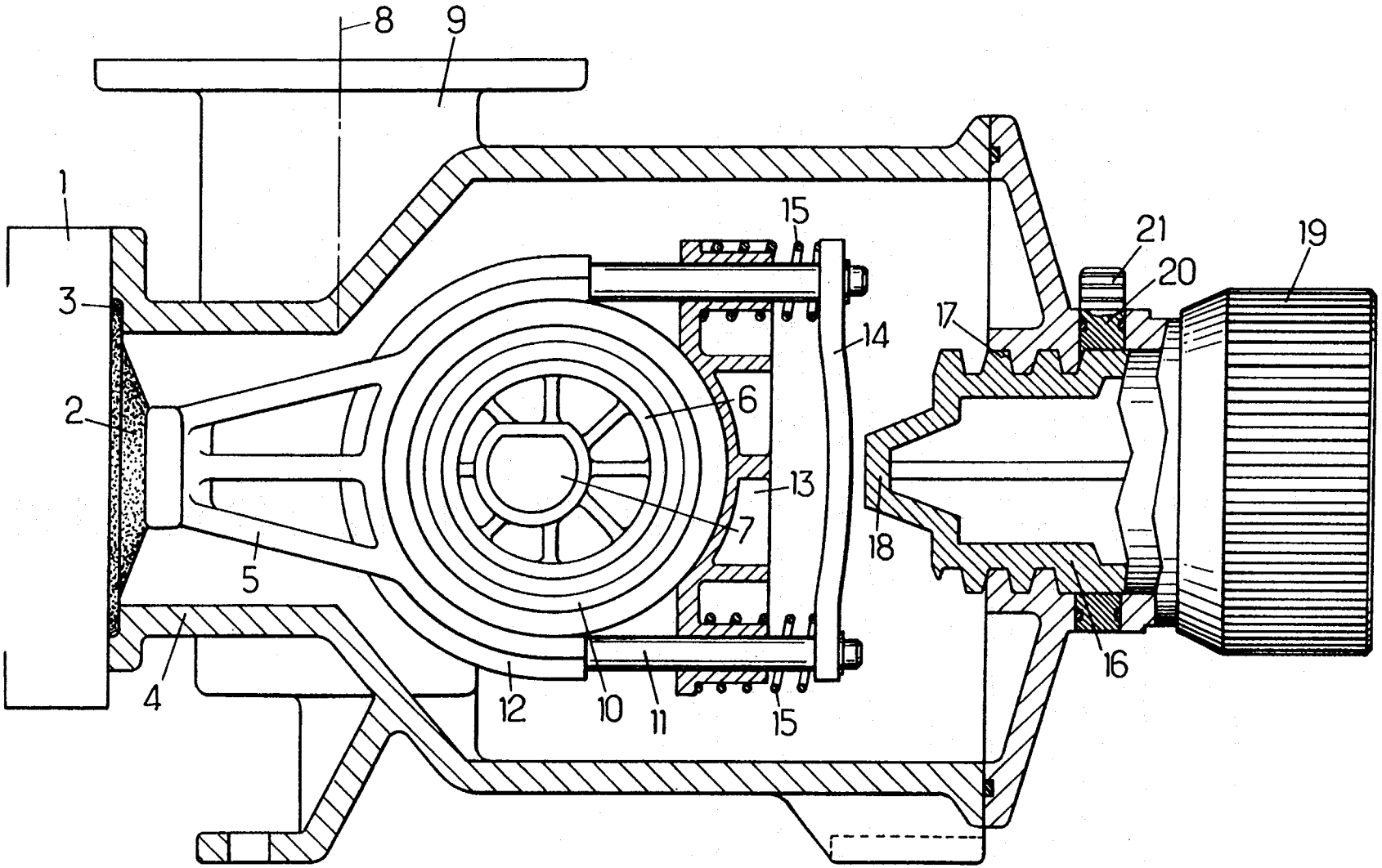
19
20
21
16
17
18
14
15
13
15
6
7
11
10
12
9
8
5
4
1
3
2

DIAPHRAGM PUMP HAVING VARIABLE DISPLACEMENT

The present invention relates in a general manner to the field of pumps having an adjustable delivery rate and, more particularly, it relates to improvements made to interrupted-cycle diaphragm pumps having a delivery rate which can be continuously adjusted between a zero value and a maximum value, according to the preamble of claim 1.

Pumps are known in which the pumping member is given a linear to-and-fro motion by means of a variable-eccentricity crank/connecting-rod system driven by a rotating shaft (output of an electric motor or an internal combustion engine via a reduction gear, for example a worm reduction gear). However, the means to be employed for adjusting the eccentricity are often complex and require precision machining and complicated shapes. These means comprise fragile components which limit the lifetime of the mechanism. In addition, the space requirement due to the presence of the means for adjusting the stroke is, in all cases, very considerable compared to the size of the machine.

Furthermore, it is very difficult, without having recourse to too complex mechanisms, to carry out a continuous adjustment of the delivery rate between a zero value and a maximum value, especially towards the low delivery rate values.

Finally, the dead space in the pumping head (that is to say the position at the end of the compression stroke) of the pumping member linked to the connecting rod varies as a function of the stroke amplitude used, and it corresponds substantially to the middle of the swept volume (or of the stroke) when the delivery rate is set to 0%. Since the dead space increases at low settings, an appreciable reduction in efficiency is often observed for low delivery rates.

Moreover, the documents U.S. Pat. No. 3,801,232 and U.S. Pat. No. 3,661,167 describe conventional arrangements of an interrupted-cycle dosing pump comprising a rotary cam, a linearly movable piston which is held in contact with the cam by means of a spring, and an adjustable blocking means for cyclically blocking the piston at an adjustable part of its stroke.

The major drawback of these known arrangements essentially resides in the fact that the force exerted by the spring on the piston is directed in the same direction as the resisting force due to the delivery of the product displaced by the pump and is approximately of the same order of magnitude as this resisting force. The result of this is that the driving force which has to be generated in order to move the pump is approximately double the actual delivery force, which alone is useful. It is therefore necessary to have recourse to driving means which are greatly oversized in relation to the driving force, which alone is useful, and hence very high manufacturing and utilization costs.

In addition, these known pumps have other drawbacks, especially:

- since the contact of the piston on the cam is a point contact, this results in considerable wear of these components;
- the cyclic reversal of direction of the large forces is manifested, in the bearings, by banging generating a high level of noise;
- the point of contact of the cam on the end of the piston moves transversely on this end during the rotation of the cam; the force which results is therefore off-centered, in a cyclically variable manner, in relation to the axis of the piston, the consequence of which is a tendency for the component in reciprocating motion to be offset in relation to the guide members and therefore additional wear in the region of the guiding of said component in reciprocating motion.

The document EP-A-0,449,686 describes an arrangement of a dosing pump in which the spring return system of conventional pumps is replaced by a declurching system bringing into play a wedge effect with the aid of transverse balls and a transverse spring. However, the friction of the balls against the slides generates very considerable wear and the pump thus equipped is not reliable over time.

The object of the invention is essentially to remedy the drawbacks of the currently known devices and to provide an improved pump arrangement which not only enables a continuous adjustment of the delivery rate to be made between a zero value and a maximum value, including for very low values, but which, furthermore, employs less complex and more reliable means than the current pumps and, especially, which requires less driving energy and which finally proves to be more economic than the current pumps.

For this purpose, an interrupted-cycle diaphragm pump having a delivery rate which can be continually adjusted between a zero value and a maximum value, of the type defined in the preamble, is essentially one in which, being arranged in accordance with the invention, the connecting-rod big end is fitted with at least one slide (11) extending substantially in the prolongation of the connecting rod (5) on the side opposite the diaphragm (2) and capable of supporting the abovementioned bearing (10) so as to slide freely in relation to the connecting-rod big end, and in which elastic return means (15) are provided in order to hold said bearing (10) at the slide bottom in the absence of a counterforce exerted by the eccentric member on the bearing, said elastic return means acting on said bearing on the opposite side from the connecting rod.

By virtue of such an arrangement, all the components subject to wear in the prior pumps have been either discarded or improved:

- the connecting rod has been rendered solidly fastened to the diaphragm and it is the elasticity and the deformability of the latter which render the relative movements possible, instead and in place of the articulated linkage employed hitherto;
- the linkage between the cam and the connecting-rod big end is made through a bearing, and therefore over the totality of a circular surface, instead and in place of the movable point contact of the prior arrangements;
- the starting position assigned to the elastic return means results in the force developed by said means not increasing with the resisting delivery force: in the compression direction, the driving force must overcome only the resisting delivery force whereas, in the suction direction, the driving force must overcome only the force of the return means; the driving means may thus have smaller dimensions, and therefore be less bulky and especially less expensive as regards both manufacture and servicing;
- in a general manner, the dynamic balancing of the moving components is better than in the prior machines and this results in better operating conditions, less wear and less vibration, and hence less operating noise.

Only the contact between the movable stop and the bearing surface of the connecting rod is still subject to wear; however, this wear is easily compensated for by carrying out a recalibration (with the aid of a Vernier system which can be actuated from the outside) without it being necessary to dismantle the pump. However, it will be noted that, by reason of the lower force due to the particular positioning of the elastic return means, the wear-generating force is reduced to a third or a quarter of that which it was in the prior pumps: the operating time between adjustments then increases correspondingly.

Finally, it will be noted that, contrary to the systems employed hitherto, the pump arranged in accordance with the invention uses a true crank/connecting-rod system which is a simpler mechanical structure than the prior systems.

Advantageously, in a simple construction, the adjustment means comprise:

a bearing surface solidly fastened to the connecting rod, a movable stop capable of interacting with the bearing surface during the movement of the connecting rod when the connecting rod has traveled a desired fraction of its stroke, and control means for moving the stop and bringing it into a position corresponding to a desired delivery rate of the pump.

In this case, the bearing surface may be supported by the slide at the free end of the latter and in the prolongation of the connecting rod. In order to obtain a more compact structure, it is then desirable for the arrangement to be such that the bearing surface constitutes a movement stop for the sliding bearing. Still within the same concern of simplifying the structure, the elastic return means may bear on the bearing surface.

Still using the previous arrangements, an actual construction of a pump according to the invention may combine the following complementary arrangements:

the slide comprises two slide rods supported by the connecting-rod big end and separated from each other, extending in the prolongation of the connecting rod, the bearing surface is a rigid component extending transversely to the connecting rod and fixed to the respective free ends of the two slide rods, the sliding bearing is flanged so as to slide freely on the two slide rods, and the elastic return means comprise two helical springs respectively surrounding the two slide rods and interposed between the bearing and the bearing surface.

Finally, it may be advantageous for the means for controlling the movable stop to comprise a threaded rod rotating in a fixed threaded bore, the end of the threaded rod forming or supporting the stop.

Thus, in accordance with the invention, a pump, especially a dosing pump, is formed, the delivery rate of which can be adjusted, in an entirely continuous manner, between a zero delivery rate and a maximum delivery rate, the continuity of the adjustment still remaining for the very low delivery rates.

The diaphragm still occupies the same position at the end of the compression stroke irrespective of the delivery rate set and the problems of variation in the dead space and in a reduction in efficiency at low delivery rates, exhibited by the prior pumps, no longer arise.

Finally, the mechanical structure of the entire pump remains simple, including that regarding the means for controlling the delivery rate, and barely subject to wear, thereby having a beneficial influence on the manufacturing and servicing costs. The motorization of the pump may be less powerful and therefore less expensive.

The invention will be better understood upon reading the detailed description which follows of a preferred embodiment given solely by manner of nonlimiting example. In this description, reference is made to the appended drawing in which the single figure is a side view, with the casing removed, of an interrupted-cycle diaphragm pump arranged according to the invention.

In a suction/delivery chamber 1 (only a suggestion of which is seen in FIG. 1), a hollowed-out part of the wall of the latter receives a deformable diaphragm 2 solidly fastened in a sealed manner via its peripheral edge 3 to a casing 4. The center of the diaphragm 2 is solidly fastened (possibly with freely rotating articulation) to one end of a connecting rod 5, the other end of which is coupled, via means indicated hereinbelow, to an eccentric wheel 6 in continuous rotation. The eccentric wheel 6 is solidly fastened to a rotating shaft 7 which is driven by driving means, for example via a worm reduction gear (suggested in the drawing by its axis 8 and its casing 9) and spur gear (not visible, keyed onto the shaft 7).

Associated with the wheel 6 is an external rolling bearing 10, the outer shell of which is fitted between two slide arms or rods 11 supported by and solidly fastened to the connecting rod 5, the said slide rods extending parallel to the axis of the connecting rod 5. The connection of the slide rods 11 to the connecting rod is constituted in the form of a semicircular component 12 attached to the end of the connecting rod or forming an integral part of the latter, the bearing 10 being able to be housed in the rounded portion of the component 12 (the position shown in the Figure). The bearing 10 is equipped with two diametrally opposed flanges surrounding respectively the freely sliding slide rods 11; these two flanges may be combined in the form of a single support plate 13 engaged so as to slide freely on the rods 11.

The free ends of the slide rods 11 are braced by a linkage component 14, another function of which will appear later, the component 14 being located away from the bearing 10 and/or from the support plate 13 when the bearing 10 is in contact with the rounded component 12. The component 14 may thus also form an end-of-stroke stop during the movement of the bearing 10.

Finally, two helical springs 15, respectively surrounding the rods 11, are interposed between the support plate 13 and the linkage component 14 in order to push the bearing 10 back up against the rounded component 12 in the absence of a counterforce generated by the eccentric wheel 6.

A threaded rod 16 extends in the prolongation of the connecting rod and facing the linkage component 14, this threaded rod 16 rotating in a threaded bore 17 passing through the wall of the casing 4. The internal end 18 of the threaded rod 16 forms a movable stop (rotation of the rod 16 resulting in its axial movement) capable of interacting with the linkage component 14 solidly fastened to the connecting rod 5 and which, in this case, serves as a bearing surface for the said connecting rod.

An external handle 19 enables the threaded rod 16 to be rotated. In order to block the threaded rod 16 in any desired axial position, blocking means may be provided having an eccentric ring 20 which surrounds the threaded rod and which can be actuated in rotation by a gripping knob 21.

The operation is as follows.

When the stop 18 is located outside the path of the connecting-rod big end (set of members 10 to 15) associated with the eccentric wheel 6, that is to say the threaded rod being unscrewed (moved to the right, as shown in the Figure), the connecting rod 5 is driven freely by the eccentric wheel over the totality of each rotational turn of the latter. The diaphragm 2 is then given a reciprocating to-and-fro motion, the extreme positions of which correspond to the two dead-center positions (left and right in the Figure of the reciprocating motion). The amplitude of this motion is proportional to the eccentricity of the wheel 6. The delivery rate of the pump is then at its maximum value.

If, now, by rotating the threaded rod 16, the stop 18 is moved to the left, the linkage component 14 strikes this stop after having traveled a fraction of the connecting-rod stroke, which depends on the axial position of the stop. The connecting rod 5 is then blocked in its axial movement, whereas, beneath the thrust of the eccentric wheel 6 driven by the shaft 7, the bearing 10 completes its motion by sliding on the slides 11, with compression of the springs 15, in the direction of the linkage component 14. The diaphragm 2 is therefore driven only for a fraction of the connecting-rod stroke and the delivery rate of the pump is set to a value corresponding to said fraction of stroke, in other words corresponding to the axial position of the stop.

By moving the stop to the maximum position, the connecting rod remains blocked in the dead-center position located to the left (in the Figure) and the diaphragm is no longer driven. The delivery rate of the pump is zero, while the drive shaft 7 continues to rotate, driving the bearing 10.

In all cases, irrespective of the effective stroke of the connecting rod 5, the diaphragm 2 always occupies the same axial position when the connecting rod is at the dead-center position on the left (in the Figure). The dead space of the pump therefore remains constant irrespective of the delivery rate of the pump, including for the low delivery rates or the zero delivery rate.

I claim:

1. A diaphragm pump having a delivery rate which can be continuously adjusted between a zero value and a maximum value, comprising:

a continuously rotating eccentric drive member, a connecting rod possessing, at one of its ends, a connecting-rod big end fitted with a bearing receiving, so as to rotate freely, the eccentric drive member and the other end of which is coupled to a central area of the diaphragm, releasable coupling means for coupling, in a selective manner, said connecting-rod big end to the eccentric drive member during a desired, continuously adjustable fraction of stroke, and adjustment means for adjusting, in a continuous manner, the desired fraction of stroke of the connecting rod between two extreme positions, these adjustment means comprising movable stop means capable of interacting with a bearing surface solidly fastened to the connecting rod, in which pump the connecting-rod big end is fitted with at least one slide extending substantially in the prolongation of the connecting rod on the opposite side from the diaphragm and capable of supporting the above-mentioned bearing so as to slide freely in relation to the connecting-rod big end, and in which pump elastic return means are provided in order to hold said bearing at the bottom of the slide in the absence of counterforce exerted by the eccentric member on the bearing, said elastic return means acting on said bearing on the opposite side from the connecting rod.

2. The pump as claimed in claim 1, wherein the adjustment means comprise:

a bearing surface solidly fastened to the connecting rod, a movable stop capable of interacting with the bearing surface during the motion of the connecting rod when the connecting rod has traveled said desired fraction of its stroke, and control means for moving the stop and bringing it into a position enabling it to limit the stroke of the connecting rod to said desired fraction.

3. The pump as claimed in claim 2, wherein the bearing surface is supported by the slide at the free end of the latter and in the prolongation of the connecting rod.

4. The pump as claimed in claim 2, wherein the bearing surface is supported by the slide at the free end of the latter and in the prolongation of the connecting rod and wherein the bearing surface furthermore constitutes a movement stop for the sliding bearing.

5. The pump as claimed in claim 2, wherein the bearing surface is supported by the slide at the free end of the latter and in the prolongation of the connecting rod and wherein the elastic return means bear on the bearing surface.

6. The pump as claimed in claim 2, wherein the bearing surface is supported by the slide at the free end of the latter and in the prolongation of the connecting rod, wherein the bearing surface furthermore constitutes a movement stop for the sliding bearing, and wherein the elastic return means bear on the bearing surface.

7. The pump as claimed in claim 2, wherein the slide comprises two slide rods supported by the connecting-rod big end and separated from each other, extending in the prolongation of the connecting rod, wherein the bearing surface is a rigid component extending transversely to the connecting rod and fixed to the respective free ends of the two slide rods, wherein the sliding bearing is flanged so as to slide freely on the two slide rods, and wherein the elastic return means comprise two helical springs respectively surrounding the two slide rods and interposed between the bearing and the bearing surface.

8. The pump as claimed in claim 2, wherein the means for controlling the movable stop comprise a threaded rod rotating in a fixed threaded bore, the end of the threaded rod forming or supporting the stop.

9. The pump as claimed in claim 8, wherein it furthermore possesses blocking means capable of blocking the threaded rod in any desired axial position.

* * * * *